US010418729B2

(12) United States Patent
Burris

(10) Patent No.: US 10,418,729 B2
(45) Date of Patent: Sep. 17, 2019

(54) COAXIAL CABLE CONNECTOR

(71) Applicant: Corning Optical Communications RF LLC, Glendale, AZ (US)

(72) Inventor: Donald Andrew Burris, Peoria, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 15/779,258

(22) PCT Filed: Oct. 24, 2016

(86) PCT No.: PCT/US2016/058471
§ 371 (c)(1),
(2) Date: May 25, 2018

(87) PCT Pub. No.: WO2017/091311
PCT Pub. Date: Jun. 1, 2017

(65) Prior Publication Data

US 2018/0358719 A1 Dec. 13, 2018

Related U.S. Application Data

(63) Continuation of application No. 14/951,623, filed on Nov. 25, 2015, now Pat. No. 9,525,220.

(51) Int. Cl.
*H01R 13/40* (2006.01)
*H01R 9/05* (2006.01)
(Continued)

(52) U.S. Cl.
CPC ..... *H01R 9/0524* (2013.01); *H01R 13/502* (2013.01); *H01R 13/504* (2013.01);
(Continued)

(58) Field of Classification Search
CPC ..... H01R 13/5202; H01R 13/5205
(Continued)

(56) References Cited

U.S. PATENT DOCUMENTS 6,558,194 B2 5/2003 Montena
6,733,336 B1 5/2004 Montena et al.
(Continued)

OTHER PUBLICATIONS

International Search Report and Written Opinion PCT/US2016/058471 dated Feb. 1, 2017.
(Continued)

*Primary Examiner* — Phuong K Dinh
(74) *Attorney, Agent, or Firm* — Tamika A. Crawl-Bey

(57) ABSTRACT

A coaxial connector having an axially moveable shell in opposition to a separate and distinct body component wherein the moveable shell contains a gripping member capable of having the front portion displaced radially inwardly by the body so that the gripping member is positioned within the connector body and between the connector body and the coaxial cable and secures the cable to the connector and environmentally seals the junction while at the same time the shell contains a structure to move a rear portion of the gripping member radially outwardly upon compression. In some embodiments disclosed herein the shell contains a structure to prevent a rear portion of the gripping member from moving radially inwardly upon compression. Other connector shell embodiments may be made from a one-piece stamping instead of a machined component and thereby deliver a manufacturing cost savings.

20 Claims, 6 Drawing Sheets

(51) Int. Cl.

| | |
|---|---|
| ***H01R 24/40*** | (2011.01) |
| ***H01R 43/00*** | (2006.01) |
| ***H01R 13/502*** | (2006.01) |
| ***H01R 13/504*** | (2006.01) |
| ***H01R 43/18*** | (2006.01) |
| *H01R 103/00* | (2006.01) |

(52) U.S. Cl.
CPC ..... *H01R 24/40* (2013.01); *H01R 43/00* (2013.01); *H01R 43/18* (2013.01); *H01R 2103/00* (2013.01)

(58) Field of Classification Search
USPC ..... 439/589, 578
See application file for complete search history.

(56) References Cited

U.S. PATENT DOCUMENTS

| | | | | |
|---|---|---|---|---|
| 6,767,248 | B1 | 7/2004 | Hung | |
| 6,776,657 | B1 | 8/2004 | Hung | |
| 6,848,940 | B2 | 2/2005 | Montena | |
| 7,018,235 | B1 | 3/2006 | Burris et al. | |
| 7,183,639 | B2 | 2/2007 | Mihara et al. | |
| 8,376,769 | B2 | 2/2013 | Holland et al. | |
| 8,382,517 | B2 | 2/2013 | Mathews | |
| 8,506,525 | B2 | 8/2013 | Bosarge | |
| 8,734,173 | B2 * | 5/2014 | Suzuki | H01R 13/193 439/262 |
| 9,048,599 | B2 | 6/2015 | Burris | |
| 9,172,154 | B2 | 10/2015 | Burris | |
| 9,287,659 | B2 | 3/2016 | Burris et al. | |
| 9,407,016 | B2 | 8/2016 | Burris | |
| 2008/0020635 | A1 | 1/2008 | Chee et al. | |
| 2011/0111623 | A1 | 5/2011 | Burris et al. | |
| 2014/0273620 | A1 | 9/2014 | Burris | |
| 2014/0322968 | A1 | 10/2014 | Burris | |
| 2014/0342605 | A1 | 11/2014 | Burris et al. | |
| 2015/0295331 | A1 | 10/2015 | Burris | |

OTHER PUBLICATIONS

English Translation of CN201680078043.9 First Office Action dated Apr. 30, 2019, China Patent Office, 7 Pgs.

* cited by examiner

COAXIAL CABLE CONNECTOR

CROSS REFERENCE TO RELATED APPLICATIONS

This application claims the benefit of priority of U.S. Provisional Application Ser. No. 14/951,623, filed Nov. 25, 2015, the content of which is relied upon and incorporated herein by reference in its entirety.

BACKGROUND

Field

The present invention relates generally to coaxial cable connectors, and particularly to coaxial cable connectors including a compression mechanism for use with coaxial cables.

Technical Background

Coaxial cable connectors such as F-connectors are used to attach coaxial cable to another object such as an appliance or junction having a terminal adapted to engage the connector. Coaxial cable F-connectors are often used to terminate a drop cable in a cable television system. The coaxial cable typically includes a center conductor surrounded by a dielectric, in turn surrounded by a conductive grounding foil and/or braid (hereinafter referred to as a conductive grounding sheath); the conductive grounding sheath is itself surrounded by a protective outer jacket. The F-connector is secured over the prepared end of the jacketed coaxial cable, allowing the end of the coaxial cable to be connected with a terminal block, such as by a threaded connection or slidable engagement with a threaded terminal of a terminal block.

SUMMARY

A coaxial connector having an axially moveable shell in opposition to a separate and distinct body component wherein the moveable shell contains a gripping member capable of having the front portion displaced radially inwardly by the body so that the gripping member is positioned within the connector body and between the connector body and the coaxial cable and secures the cable to the connector and environmentally seals the junction while at the same time the shell contains a structure to move a rear portion of the gripping member radially outwardly upon compression. In some embodiments disclosed herein the shell contains a structure to prevent a rear portion of the gripping member from moving radially inwardly upon compression. Other connector shell embodiments may be made from a one-piece stamping instead of a machined component and thereby deliver a manufacturing cost savings.

In some embodiments, coaxial cable connectors for connecting a coaxial cable comprising an inner conductor, an insulator layer surrounding the inner conductor, an outer conductor layer surrounding the insulator layer and an outer jacket are provided. In one embodiment, the coaxial cable connector includes a body, a shell and a gripping member. The body includes a rear end, a front end, and an internal surface extending between the rear and front ends of the body, the internal surface defining a longitudinal opening. The shell includes a rear end, a front end surrounding at least a portion of the body, an inner surface defining a longitudinal opening extending between the rear and front ends of the shell and a forwardly angled surface, the shell being axially movable over an outside portion the body between a first rearward position and a second forward position. The gripping member is adapted to secure a coaxial cable to the coaxial cable connector, the gripping member disposed at least partially within the longitudinal opening of the shell, the gripping member comprising a front end, a rear end, an outer surface, an inner surface defining an opening therein. The forward angled surface of the shell is adapted to displace at least a portion of the rear end of the gripping member radially outwardly as the shell is moved from the first rearward position toward the second forward position.

In another embodiment, methods for securing a coaxial cable to a coaxial cable connector are provided. In one embodiment, the method includes inserting a coaxial cable through an inner bore of a body, shell and gripping member of coaxial cable connector. The body includes a rear end, a front end, and an internal surface extending between the rear and front ends of the body. The internal surface defines a longitudinal opening. The shell includes a rear end, a front end surrounding at least a portion of the body, an inner surface defining a longitudinal opening extending between the rear and front ends of the shell and a forwardly angled surface. The shell is axially movable over an outside portion the body between a first rearward position and a second forward position. The gripping member is disposed at least partially within the longitudinal opening of the shell. The gripping member includes a front end, a rear end, an outer surface and an inner surface defining an opening therein. The method further includes axially sliding the shell in a forward direction relative to the body. The forward angled surface of the shell is adapted to displace at least a portion of the rear end of the gripping member radially outwardly as the shell is moved from the first rearward position toward the second forward position.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate embodiments, and together with the description serve to explain principles and operation of the various embodiments.

Figure 5:
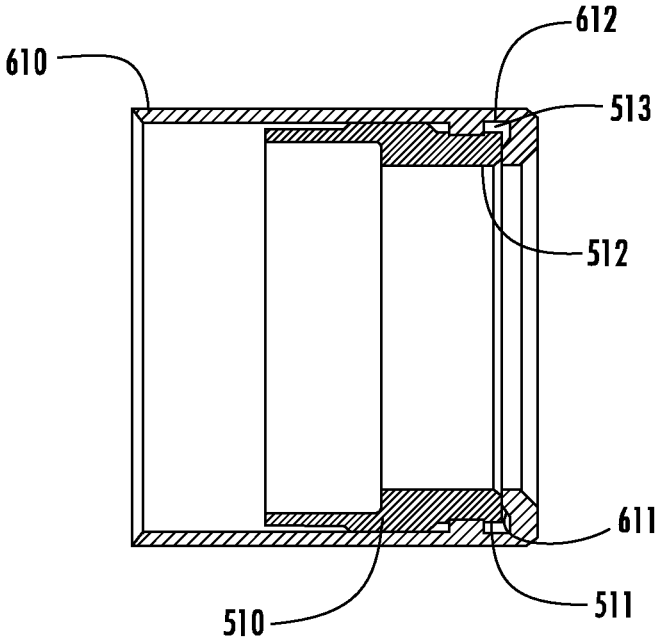
Figure 6:
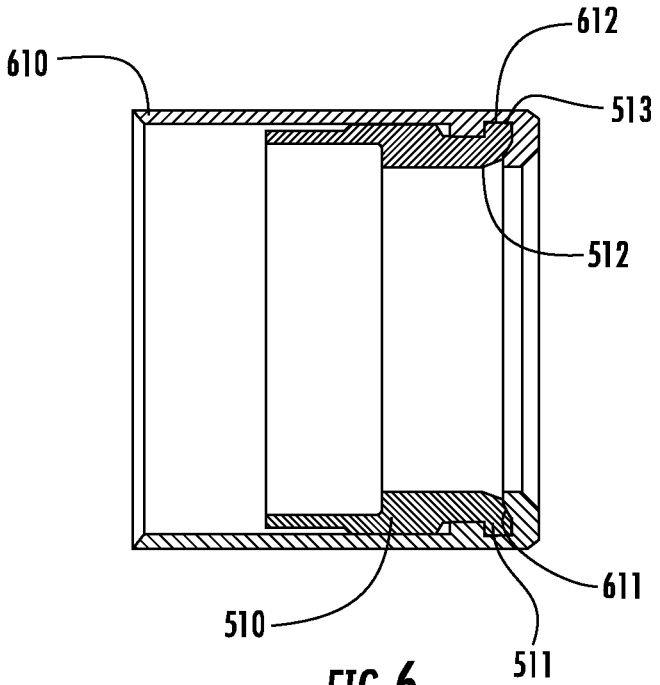
Figure 7:
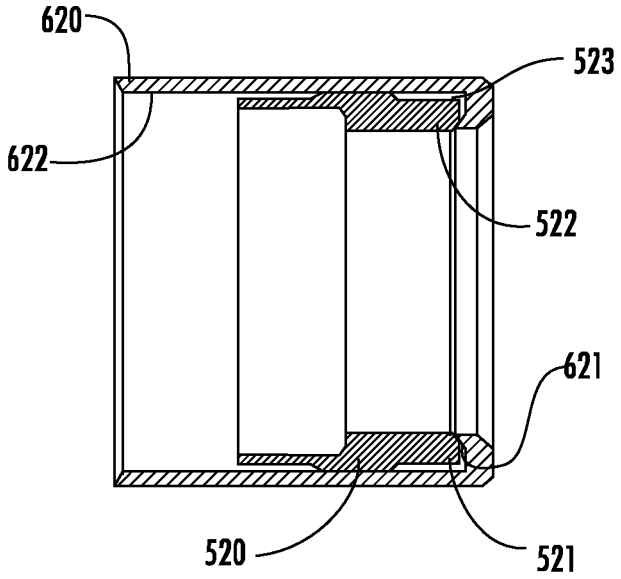
Figure 8:
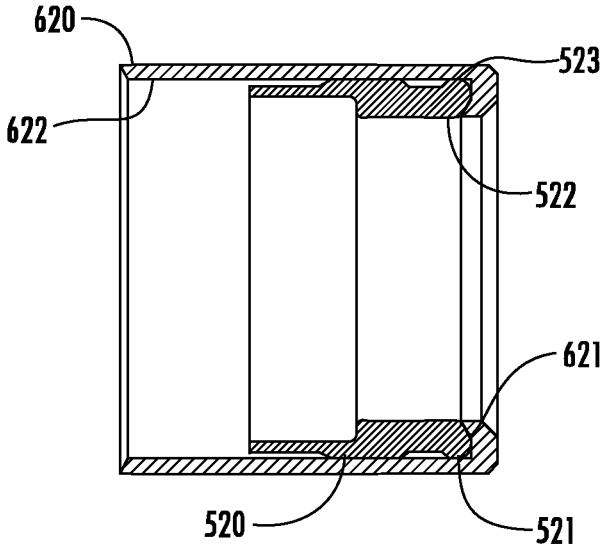
Figure 9:
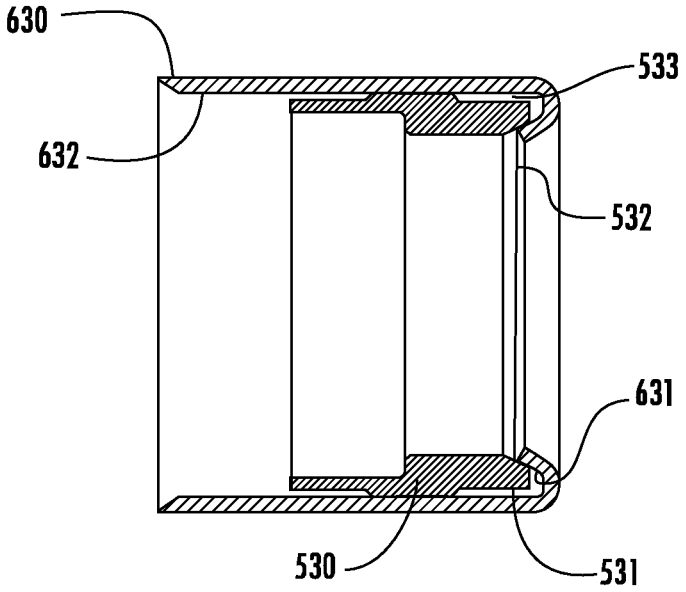
Figure 10:
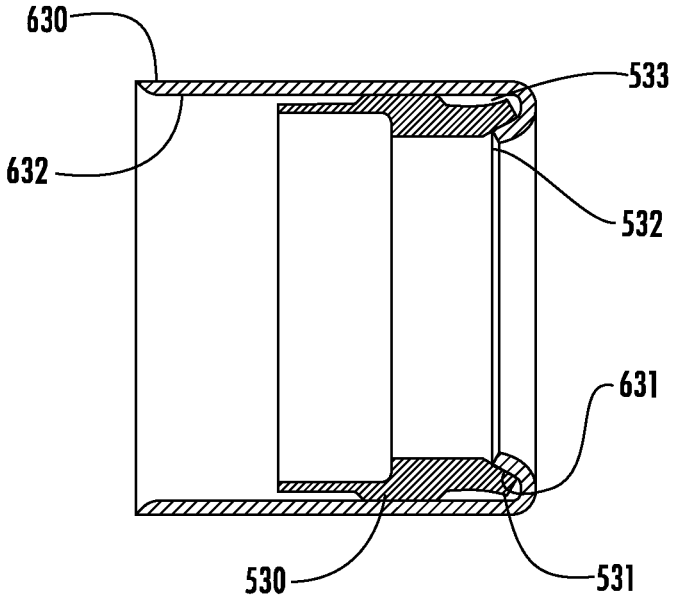
Figure 11:
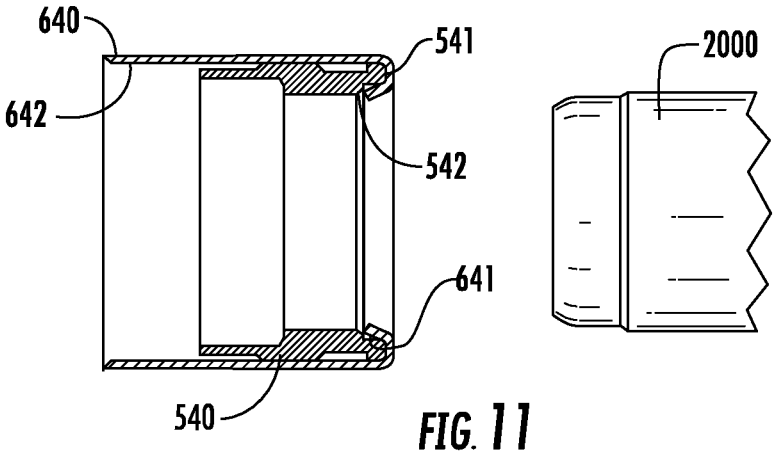
Figure 12:
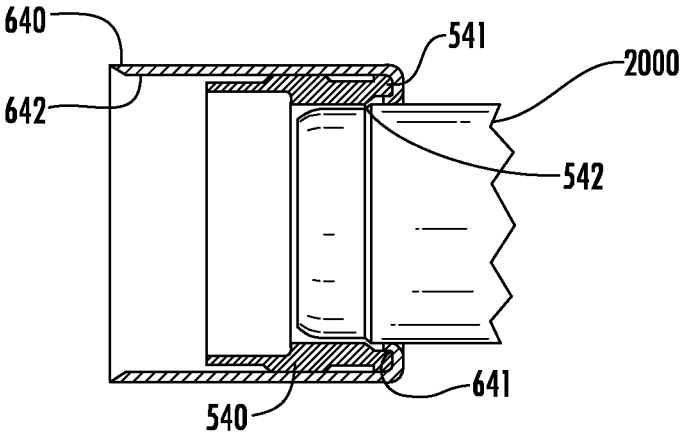
Figure 13:
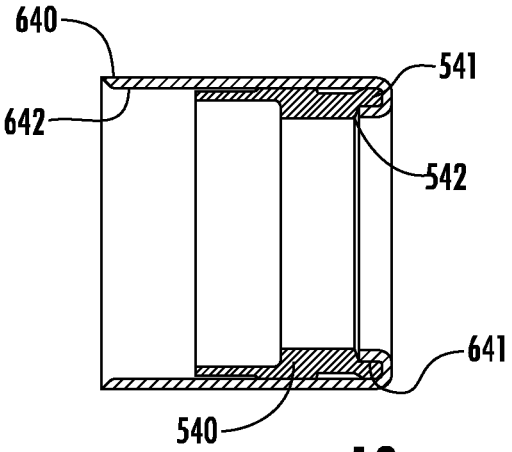

a FIG. 5 schematically depicts a cross section of another example embodiment of a gripping member and a shell of a coaxial cable connector as a sub-assembly in a first uncompressed position according to one or more embodiments described and illustrated herein;

FIG. 6 schematically depicts a cross section of the example embodiment of the gripping member and the shell shown in FIG. 5 as a sub-assembly in a second compressed position according to one or more embodiments described and illustrated herein;

FIG. 7 schematically depicts a cross section of an example embodiment of a gripping member and a shell as a sub-assembly in a first uncompressed position according to one or more embodiments described and illustrated herein;

FIG. 8 schematically depicts a cross section of an example embodiment of a gripping member and a shell as a sub-assembly in a second compressed position according to one or more embodiments described and illustrated herein;

FIG. 9 schematically depicts a cross section of another example embodiment of a gripping member and a shell as a sub-assembly in a first uncompressed position according to one or more embodiments described and illustrated herein;

FIG. 10 schematically depicts a cross section of the example embodiment of the gripping member and the shell shown in FIG. 9 as a sub-assembly in a second compressed position according to one or more embodiments described and illustrated herein;

FIG. 11 schematically depicts a cross section of another example embodiment of a gripping member and a shell as a partially completed sub-assembly in a first uncompressed position according to one or more embodiments described and illustrated herein;

FIG. 12 schematically depicts a cross section of the gripping member and the shell as a sub-assembly in which a forming tool has been introduced to complete the sub-assembly according to one or more embodiments described and illustrated herein; and FIG. 13 schematically depicts a cross-section of the gripping member and the shell as sub-assembly in a final assembled condition with the forming tool removed according to one or more embodiments described and illustrated herein.

Reference will now be made in detail to various embodiment(s) of a coaxial cable connector, examples of which are illustrated in the accompanying drawings. Whenever possible, the same reference numerals will be used throughout the drawings to refer to the same or like parts.

DETAILED DESCRIPTION

Embodiments disclosed herein coaxial cable connectors used to connect a coaxial cable to an equipment port or terminal such that secure mechanical and electrical connections result. The terms "equipment port" and "terminal" may be used interchangeably herein. It should be understood that each of these terms shall mean or refer to any device or structure to which the coaxial cable connector attaches to mechanically and/or electrically connect a coaxial cable thereto. The coaxial cable connector includes attachment feature for attaching the coaxial cable connector to the equipment port or terminal. The attachment feature may be any suitable attachment device, including, without limitation, rotatable coupler, also referred to as a nut, or push-on component. A body is secured to the coupler at one end in a manner so that it does not rotate with coupler. A post is secured to and inside of the body. A shell is movably attached to the body at another end such that shell can axially move toward coupler. A gripping member is frictionally fit inside of shell. The shell accepts the coaxial cable which is inserted through shell and the gripping member and is secured to an end of post so that coaxial cable positions between post and body inside of body. The gripping member is configured to secure coaxial cable to coaxial cable connector. In this regard, when an axially compressive force is applied to shell to move shell axially toward coupler, the gripping member also moves and at least a part of gripping member is forced between body and coaxial cable.

The gripping member has a front end and a rear end opposite the front end, and an outer surface and an inner surface defining a longitudinal hole extending between the front end and the rear end. A first portion of the gripping member terminates at the front end. A second portion of the gripping member terminates at the rear end. The gripping member is configured to secure the coaxial cable to the coaxial cable connector. The gripping member secures the coaxial cable to the coaxial cable connector when at least part of the gripping member is forced under the body. The gripping member may be forced under body of a coaxial cable connector when driven axially forward by the shell to secure coaxial cable to the connector. When forced under the body, the first portion or front end the gripping member may be displaced radially inwardly. The shell includes a structure to move the rear end/second portion of the gripping member radially outwardly upon compression. In some embodiments, the shell includes a structure to prevent a rear portion of the gripping member from moving radially inwardly upon compression. In various embodiments, the structure may comprise, for example, a machined component, a stamped component such as a one- or multi-piece stamped component, or another structure adapted to move a rear portion of the gripping member radially outwardly upon compression and/or prevent a rear portion of the gripping member from moving radially inwardly upon compression. Various embodiments of connectors and coaxial cable assemblies are described in detail below.

Figure 1:
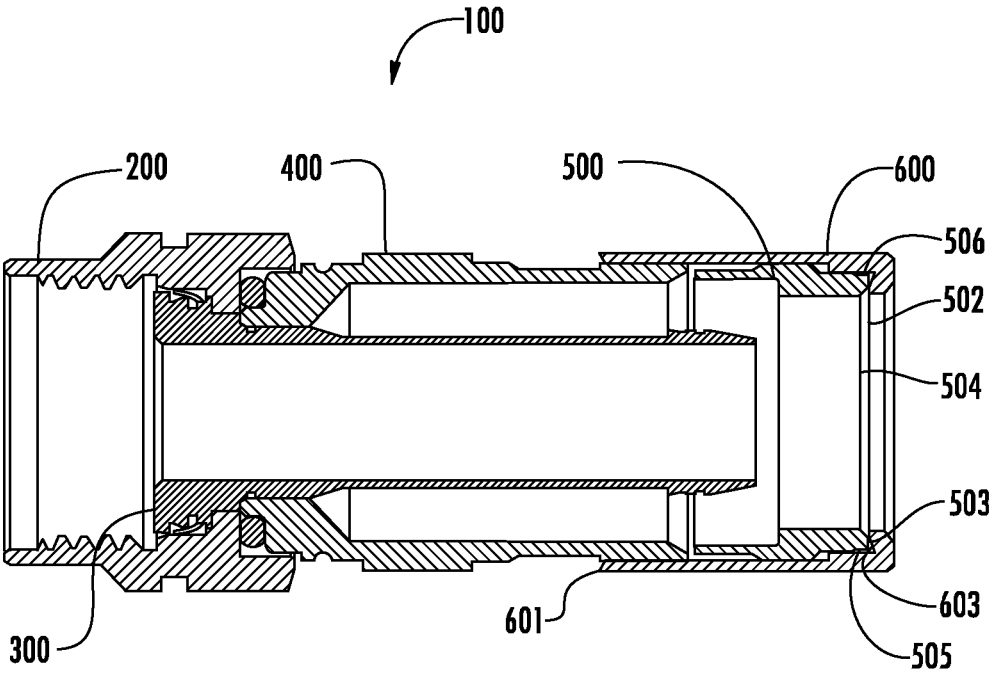
FIG. 1 schematically depicts a cross sectional view of an example embodiment of a coaxial cable connector for coupling an end of a coaxial cable to a terminal according to one or more embodiments described and illustrated herein.

A coaxial cable has a center or inner conductor that is surrounded by a dielectric layer. The dielectric layer (or dielectric) may also have a foil or other metallic covering. The coaxial cable then has a braided outer conductor which is covered and protected by a jacket. Typically, to prepare the coaxial cable for attachment to a coaxial cable connector, a portion of the center conductor is exposed. The jacket is trimmed back so that a portion of the dielectric (and metallic covering) and braided outer conductor are exposed. The braided outer conductor is then folded back over the jacket, to expose the dielectric (and the metallic covering if present). Whenever possible, the same reference numerals will be used throughout the drawings to refer to the same or like parts FIG. 1 schematically depicts a cross sectional view of an example embodiment of a coaxial cable connector 100 for coupling an end of a coaxial cable to a terminal. In this embodiment, the coaxial cable connector 100 includes a coupler 200 adapted to couple to the terminal. The coaxial cable connector 100 also includes a body 400 secured to the coupler 200 at one end in a manner so that the body 400 does not rotate with coupler 200. A post 300 is secured to and disposed inside of the body 400. A shell 600 is movably attached to the body 400 at an opposite end such that the shell 600 can axially move toward coupler 200. A gripping member 500 is frictionally fit inside of the shell 600. The shell 600 accepts the coaxial cable which is inserted through shell 600 and the gripping member 500 and is secured to an end of the post 300 so that the coaxial cable positions between the post 300 and the body 400 inside of the body. The gripping member 500 is configured to secure the coaxial cable to the coaxial cable connector 100. In this regard, when an axially compressive force is applied to the shell 600 to move the shell 600 axially toward the coupler 200, the gripping member 500 also moves and at least a part of the gripping member 500 is forced between the body 400 and the coaxial cable.

In one embodiment, the coupler 200, the post 300, the body 400, and the shell 600 may be made from a conductive material such as nickel plated brass or the like. The gripping member 500 may be made from a non-conducting material, such as a plastic such as acetal. The gripping member 500 at least partially includes a front portion 501, a back portion 502, a rearward facing surface 503, an internal surface 504, and a reduced diameter portion 505. The shell 600 at least partially includes a front end 601, a back end 602 and a surface 603. The reduced diameter portion 505 creates an annular gap 506 between the gripping member 500 and the shell 600. The surface 603 of the shell 600 is configured to drive the rearward facing surface 503 and at least a portion of the internal surface 504 of the gripping member 500 radially outwardly when driven axially against the rearward facing surface 503 by means of a reverse rake angle of the surface 603 oriented in a direction angled from the rear end 602 of the shell 600 toward the front end 601 of the shell 600 as the surface 603 extends from an inner surface of the shell 600 into a longitudinal opening defined by the shell 600.

Figure 2:
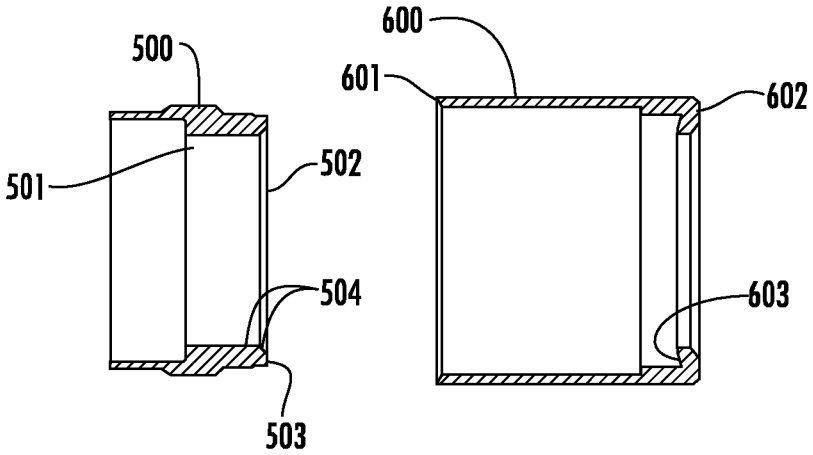
FIG. 2 schematically depicts a cross sectional view of an example embodiment of a gripping member and a shell of the coaxial cable connector shown in FIG. 1 in an unassembled state according to one or more embodiments described and illustrated herein.

FIG. 2 schematically depicts a cross sectional view of an example embodiment of a gripping member 500 and a shell 600 of the coaxial cable connector 100 shown in FIG. 1 in an unassembled state. As described above with reference to FIG. 1, the gripping member 500 includes a front portion 501, a back portion 502, a rearward facing surface 503, an internal surface 504, and a reduced diameter portion 505. The shell 600 at least partially includes a front end 601, a back end 602 and a surface 603. The reduced diameter portion 505 of the gripping member 500 creates an annular gap 506 between the gripping member 500 and the shell 600. The surface 603 of the shell 600 is configured to drive the rearward facing surface 503 and at least a portion of the internal surface 504 of the gripping member 500 radially outwardly when driven axially against the rearward facing surface 503 by means of a reverse rake angle of the surface 603 oriented in a direction angled from the rear end 602 of the shell 600 toward the front end 601 of the shell 600 as the surface 603 extends from an inner surface of the shell 600 into a longitudinal opening defined by the shell 600. Thus, in this embodiment, a distal end of the forward angled surface extends into the longitudinal opening of the shell and is disposed forward (i.e., closer to the front end 601) relative to a proximal end of the forward facing surface disposed at or near (e.g., at least generally adjacent to) the inner surface of the shell 600.

Figure 3:
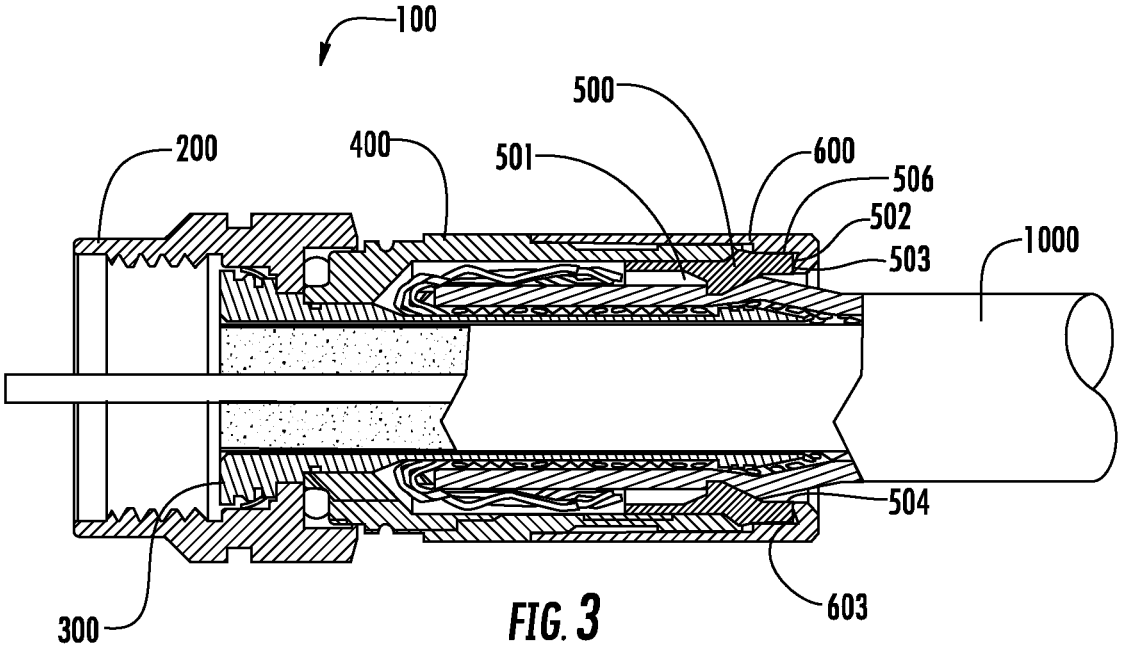
FIG. 3 schematically depicts the example embodiment of the coaxial cable connector shown in FIG. 1 with a coaxial cable inserted into the coaxial cable connector according to one or more embodiments described and illustrated herein.

FIG. 3 schematically depicts the example embodiment of the coaxial cable connector 100 shown in FIG. 1 with a coaxial cable 1000 inserted into the coaxial cable connector 100. In FIG. 3, the coaxial cable connector 100 is in a closed condition in which the shell 600 has been axially moved in a forward direction over the body 400 toward the coupler 200 of the connector 100. The front portion 501 of the gripping member 500 has been forced cylindrically into or under the body 400 and has been deformed radially inwardly towards the coaxial cable 1000. In one embodiment, for example, the front portion 501 of the gripping member contacts an outer jacket of the coaxial cable 1000 as shown in FIG. 3 and further environmentally seals the junction of the coaxial cable connector 100 and the coaxial cable 1000.

At least a portion of the rear portion 502, a portion of the internal surface 504, and a portion of the rearward facing surface 503 of the gripping member 500 have been forced at least partially radially outwardly by the angled surface 603 of the shell 600 as evidenced by a volumetric reduction in an annular gap 506 and by the general shape of the resulting component configuration.

Figure 4:
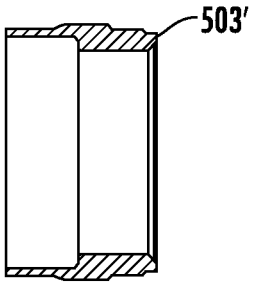
FIG. 4 schematically depicts a cross section of another example embodiment of a gripping member of a coaxial cable connector according to one or more embodiments described and illustrated herein.

FIG. 4 schematically depicts a cross section of another example embodiment of a gripping member 500' of a coaxial cable connector according to one or more embodiments. In the particular implementation shown in FIG. 4, for example, a rearward facing surface 503' of the gripping member 500' includes a reverse rake angle corresponding to the surface 603 of the shell 600 described above with respect to FIGS. 1 and 2. Thus, in the embodiment shown in FIG. 5, the rearward facing surface 503' is angled in a direction extending from the rear end 502 of the gripping member 500 toward the front portion 501 of the gripping member 500 as the surface extends from an inner surface of the gripping member 500 into a longitudinal opening of the gripping member 500.

FIG. 5 schematically depicts a cross section of another example embodiment of a gripping member 510 and a shell 610 of a coaxial cable connector as a sub-assembly in a first uncompressed position. In this embodiment, the gripping member 510 at least partially includes an outer ring 511 and an inner area 512. The shell 610 at least partially includes an angled surface 611 and a recess 612, such as formed by an annular channel in the shell 610. The recess 612 of the shell provides an annular gap 513 around the gripping member in this first uncompressed position.

FIG. 6 schematically depicts a cross section of the example embodiment of the gripping member 510 and the shell 610 shown in FIG. 5 as a sub-assembly in a second compressed position. In this embodiment, the shell 610 has been forced in an axially forward direction toward the gripping member 510 as it would be during compression of a coaxial cable connector. In this embodiment, at least a portion of the outer ring 511 and a portion of the inner area 512 of the gripping member 510 have been forced at least partially radially outwardly by the angled surface 611 of the shell 610 as evidenced by a volumetric reduction in annular gap 513, an increase in volumetric space around inner area 512, and by the general shape of the resulting component configuration.

FIG. 7 schematically depicts a cross section of an example embodiment of a gripping member 520 and a shell 620 as a sub-assembly in a first uncompressed position. In this embodiment, the gripping member 520 at least partially comprises a reduced diameter portion 521 and an inner area 522. The shell 620 at least partially includes an angled surface 621 and a bore 622. The reduced diameter portion 521 of the gripping member 520 creates annular gap 523 between the gripping member 520 and the bore 622 of the shell 620.

FIG. 8 schematically depicts a cross section of an example embodiment of a gripping member 520 and a shell 620 as a sub-assembly in a second compressed position. In this embodiment, the shell 620 has been forced in an axially forward direction toward the gripping member 520 as it would be during compression of a coaxial cable connector. As such, at least a portion of the reduced diameter portion 521 and a portion of the inner area 522 of the gripping member 520 have been forced at least partially radially outwardly by the angled surface 621 of the shell 620 as evidenced by a volumetric reduction in the annular gap 523, an increase in volumetric space around the inner area 522, and by the general shape of the resulting component configuration.

FIG. 9 schematically depicts a cross section of another example embodiment of a gripping member 530 and a shell 630 as a sub-assembly in a first uncompressed position. In this embodiment, the gripping member 530 at least partially comprises a reduced diameter portion 531 and an inner area 532. The shell 630 at least partially includes an angled surface 631 and a bore 632. The reduced diameter portion 531 of the gripping member 530 creates annular gap 533 between the gripping member 530 and the bore 632 of the shell 630. Additionally, in this implementation, the shell 630 may be produced by a stamping or deep draw operation that is more economical to produce than a shell made by machining or turning operations.

FIG. 10 schematically depicts a cross section of the example embodiment of the gripping member 530 and the shell 630 shown in FIG. 9 as a sub-assembly in a second compressed position. In this embodiment, the shell 630 has been forced in an axially forward direction toward the gripping member 530 as it would be during compression of a coaxial cable connector. As such, at least a portion of the reduced diameter portion 531 and a portion of the inner area 532 of the gripping member 520 have been forced at least partially radially outwardly by the angled surface 631 of the shell 630 as evidenced by a volumetric reduction in the annular gap 533, an increase in volumetric space around the inner area 532, and by the general shape of the resulting component configuration.

FIG. 11 schematically depicts a cross section of another example embodiment of a gripping member 540 and a shell 640 as a partially completed sub-assembly in a first uncompressed position. In this embodiment, the gripping member 540 at least partially includes an outer diameter 541 and an inner area 542. The shell 640 at least partially includes a structure 641 such as a curved forward facing surface and a bore 642. Additionally, in this implementation, the shell 640 may be produced by a stamping or deep draw operation that is more economical to produce than a shell made by machining or turning operations.

FIG. 12 schematically depicts a cross section of the gripping member 540 and the shell 640 as a sub-assembly in which a forming tool 2000 has been introduced to complete the sub-assembly by forming the structure 641 (e.g., the curved forward facing surface) of the shell 600 radially outwardly. The forming operation captures the gripping member 540 within the shell 640 and creates an annular barrier to prevent the inner area 542 of the gripping member 540 from moving radially inwardly.

FIG. 13 schematically depicts a cross-section of the gripping member 540 and the shell 640 as sub-assembly in a final assembled condition with the forming tool 2000 removed.

It should now be understood that embodiments described herein are directed to coaxial cable connectors and methods connecting coaxial cable connectors to a coaxial cable.

For the purposes of describing and defining the subject matter of the disclosure it is noted that the terms "substantially" and "generally" are utilized herein to represent the inherent degree of uncertainty that may be attributed to any quantitative comparison, value, measurement, or other representation.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the disclosure. Since modifications, combinations, sub-combinations and variations of the disclosed embodiments incorporating the spirit and substance of the disclosure may occur to persons skilled in the art, the embodiments disclosed herein should be construed to include everything within the scope of the appended claims and their equivalents.

What is claimed is:

1. A coaxial cable connector for connecting a coaxial cable comprising an inner conductor, an insulator layer surrounding the inner conductor, an outer conductor layer surrounding the insulator layer and an outer jacket, the coaxial cable connector comprising:

a body comprising a rear end, a front end, and an internal surface extending between the rear and front ends of the body, the internal surface defining a longitudinal opening;

a shell comprising a rear end, a front end surrounding at least a portion of the body, an inner surface defining a longitudinal opening extending between the rear and front ends of the shell, and a forwardly angled surface, the shell being axially movable over an outside portion of the body between a first rearward position and a second forward position; and a gripping member adapted to secure a coaxial cable to the coaxial cable connector, the gripping member disposed at least partially within the longitudinal opening of the shell, the gripping member comprising a front end, a rear end, an outer surface, and an inner surface defining an opening therein, wherein the forward angled surface of the shell is adapted to displace at least a portion of the rear end of the gripping member radially outwardly as the shell is moved from the first rearward position toward the second forward position.

2. The connector of claim 1, wherein the connector comprises a post disposed at least partially within the longitudinal opening of the body, the post having a rear end, an inner surface and an outer surface, and wherein the outer surface of the post and the internal surface of the post define an annular cavity therebetween.

3. The connector of claim 1, wherein the gripping member is disposed within the longitudinal opening of the shell between the front and rear ends of the shell.

4. The connector of claim 1, wherein the forward angled surface of the shell comprises a reverse rake angled surface.

5. The connector of claim 4, wherein the forward angled surface is oriented in a direction angled from the rear end of the shell toward the front end of the shell.

6. The connector of claim 1, wherein the forward angled surface comprises a machined surface of the shell.

7. The connector of claim 1, wherein the forward angled surface comprises a stamped surface of the shell.

8. The connector of claim 1, wherein the forward angled surface comprises a rolled surface of the shell.

9. The connector of claim 1, wherein the forward angled surface of the shell comprises a curved forward facing surface.

10. The connector of claim 1, wherein a distal end of the forward angled surface extends into the longitudinal opening of the shell and is disposed forward relative to a proximal end of the forward facing surface.

11. A method for securing a coaxial cable to a coaxial cable connector, the method comprising:

inserting a coaxial cable through an inner bore of a body, shell and gripping member of the coaxial cable connector, wherein the body comprises a rear end, a front end, and an internal surface extending between the rear and front ends of the body, the internal surface defining a longitudinal opening, wherein the shell comprises a rear end, a front end surrounding at least a portion of the body, an inner surface defining a longitudinal opening extending between the rear and front ends of the shell and a forwardly angled surface, the shell being axially movable over an outside portion the body between a first rearward position and a second forward position, and wherein the gripping member is disposed at least partially within the longitudinal opening of the shell, the gripping member comprising a front end, a rear end, an outer surface, and an inner surface defining an opening therein; and axially sliding the shell in a forward direction relative to the body, wherein the forward angled surface of the shell is adapted to displace at least a portion of the rear end of the gripping member radially outwardly as the shell is moved from the first rearward position toward the second forward position.

12. The method of claim 11, further comprising forming the forward angled surface of the shell with a forming tool.

13. The method of claim 11, further comprising forming the forward angled surface of the shell to displace the portion of the rear end of the gripping member radially outwardly.

14. The method of claim 11, wherein the connector further comprises a post disposed at least partially within the longitudinal opening of the body, the post having a rear end, an inner surface and an outer surface, and wherein the outer surface of the post and the internal surface of the post define an annular cavity therebetween.

15. The method of claim 11, wherein the forward angled surface of the shell comprises a reverse rake angled surface.

16. The method of claim 15, wherein the forward angled surface is oriented in a direction angled from the rear end of the shell toward the front end of the shell.

17. The method of claim 11, wherein the forward angled surface comprises a machined surface of the shell.

18. The method of claim 11, wherein the forward angled surface comprises a stamped surface of the shell.

19. The method of claim 11, wherein the forward angled surface comprises a rolled surface of the shell.

20. The method of claim 11, wherein the forward angled surface of the shell comprises a curved forward facing surface.

* * * * *